US008172042B2

(12) United States Patent
Wesson et al.

(10) Patent No.: US 8,172,042 B2
(45) Date of Patent: May 8, 2012

(54) ELEVATOR POWER SYSTEM

(75) Inventors: John P. Wesson, Vernon, CT (US); Mark S. Thompson, Tolland, CT (US)

(73) Assignee: Otis Elevator Company, Farmington, CT (US)

( * ) Notice: Subject to any disclaimer, the term of this patent is extended or adjusted under 35 U.S.C. 154(b) by 652 days.

(21) Appl. No.: 11/992,082

(22) PCT Filed: Oct. 7, 2005

(86) PCT No.: PCT/US2005/036101

§ 371 (c)(1),
(2), (4) Date: Mar. 6, 2009

(87) PCT Pub. No.: WO2007/044000

PCT Pub. Date: Apr. 19, 2007

(65) Prior Publication Data

US 2009/0218175 A1 Sep. 3, 2009

(51) Int. Cl.
*B66B 1/18* (2006.01)

(52) U.S. Cl. ..... 187/382; 187/290; 187/393

(58) Field of Classification Search ..... 187/247, 187/288, 289, 290, 293, 296, 297, 391–393, 187/380–388; 318/798–815, 375, 376
See application file for complete search history.

(56) References Cited

U.S. PATENT DOCUMENTS 4,376,471 A 3/1983 Uchino et al.
5,896,948 A 4/1999 Suur-Askola et al.
6,431,323 B2 8/2002 Tajima et al.
(Continued)

FOREIGN PATENT DOCUMENTS

JP 53128843 A 11/1978
(Continued)

OTHER PUBLICATIONS

State Intellectual Property Office, P.R. China, First Office Action, Sep. 11, 2009, 8 pages.

(Continued)

*Primary Examiner* — Anthony Salata
(74) *Attorney, Agent, or Firm* — Kinney & Lange, P.A.

(57) ABSTRACT

A power system (10) operates a plurality of hoist motors (18*a*, 18*b*, 18*c*), each of which controls movement of one of a plurality of elevators (12*a*, 12*b*, 12*c*). The power system (10) includes a power bus (11) and a converter (22) connected across the power bus (11) for converting alternating current (AC) power from an AC power source (20) to direct current (DC) power and delivering the DC power to the power bus (11). The power system (10) also includes a plurality of inverters (26*a*, 26*b*, 26*c*) connected across the power bus (11). Each inverter (26*a*, 26*b*, 26*c*) is connected to a hoist motor (18*a*, 18*b*, 18*c*) and is operable to drive the hoist motor (18*a*, 18*b*, 18*c*) when the hoist motor (18*a*, 18*b*, 18*c*) is motoring by converting the DC power from the power bus (11) into AC power. Each inverter (26*a*, 26*b*, 26*c*) is further operable to convert AC power produced by the hoist motor (18*a*, 18*b*, 18*c*) when the motor is generating to DC power and to deliver the DC power to the power bus (11). A controller (31) manages power on the power bus (11) by controlling operation of the converter (22) and the inverters (26*a*, 26*b*, 26*c*) to drive a motoring hoist motor with power delivered to the power bus (11) by the converter (22) and generating hoist motors.

18 Claims, 2 Drawing Sheets

U.S. PATENT DOCUMENTS

| | | | | |
|---|---|---|---|---|
| 6,732,838 | B1 * | 5/2004 | Okada et al. | 187/290 |
| 6,827,182 | B2 | 12/2004 | Araki | |
| 6,938,733 | B2 | 9/2005 | Eilinger | |
| 7,246,686 | B2 * | 7/2007 | Smith et al. | 187/290 |
| 7,681,694 | B2 * | 3/2010 | Aulanko et al. | 187/290 |
| 7,967,113 | B2 * | 6/2011 | Smith et al. | 187/393 |
| 2003/0089557 | A1 | 5/2003 | Eilinger | |
| 2010/0065380 | A1 * | 3/2010 | Chen et al. | 187/290 |
| 2011/0100760 | A1 * | 5/2011 | Acquaviva | 187/290 |

FOREIGN PATENT DOCUMENTS

| | | | |
|---|---|---|---|
| JP | 60137788 | A | 7/1985 |
| JP | 2829153 | | 9/1998 |
| JP | 11289793 | A | 10/1999 |
| JP | 2001171921 | A | 6/2001 |
| JP | 2001-261246 | | 9/2001 |
| JP | 2001247273 | A | 9/2001 |
| JP | 2003529512 | A | 10/2003 |
| JP | 2005039935 | | 2/2005 |
| JP | 2005089097 | A | 4/2005 |
| JP | 2005104681 | A | 4/2005 |
| KR | 100407627 | | 12/2003 |
| WO | 03033390 | A1 | 4/2003 |
| WO | 2005075333 | A1 | 8/2005 |

OTHER PUBLICATIONS

KIPO-KIPO's Notice of Preliminary Rejection (English Translation), Nov. 22, 2011, 6 pages.

European Patent Office, Extended European Search Report, May 18, 2011, 6 pages.

* cited by examiner

ELEVATOR POWER SYSTEM

BACKGROUND

The present invention relates to elevator systems. In particular, the present invention relates to power system for driving a plurality of elevator hoist motors.

The power demands for operating elevators range from highly positive, in which externally generated power is used at a maximal rate, to negative, in which the load in the elevator drives the motor so it produces electricity as a generator. This use of the motor to produce electricity as a generator is commonly called regeneration. On average, if all the passengers who rise up through a building on an elevator also return down through the building on the same elevator, the average power required to run the system would be zero, but for frictional losses, electrical conversion losses, and power drawn by accessory equipment (e.g., lighting). However, this typically does not occur since most elevators are dispatched based on efficiency, and power management considerations are often ignored. For example, if two or more elevators are dispatched at the same time, the overlapping current transients from the associated motors results in a significant power demand on the power supply. Thus, the deliverable power from the power supply must be very large to avoid an overload condition if all elevators start at the same time.

In addition, conventional multi-elevator power systems typically include a dedicated power bus and power converter for each hoist motor. Consequently, the power consumed by each hoist motor is independent of the power consumed by the other hoist motors of the multi-elevator power system. This results in inefficient use of the power supply. For example, a significant amount of energy generated by each of the hoist motors during regeneration may need to be dissipated as waste heat if negative power demands exceed the storage capacity of the power system. This not only is wasteful of the generated electricity, but also adds more waste in the requirement for air conditioning to keep excessive heating from occurring.

SUMMARY

The subject invention is directed to a power system for operating a plurality of hoist motors, each of which controls movement of one of a plurality of elevators. The power system includes a power bus and a converter connected across the power bus for converting alternating current (AC) power from an AC power source to direct current (DC) power and delivering the DC power to the power bus. The power system also includes a plurality of inverters connected across the power bus. Each inverter is connected to a hoist motor and operable to drive the hoist motor when the hoist motor is motoring by converting the DC power from the power bus into AC power. Each inverter is further operable to convert AC power produced by the hoist motor when the motor is generating to DC power and to deliver the DC power to the power bus. A controller manages power accumulated on the power bus by controlling operation of the converter and the inverters to drive a motoring hoist motor with power delivered to the power bus by the converter and generating hoist motors.

DETAILED DESCRIPTION

Figure 1:
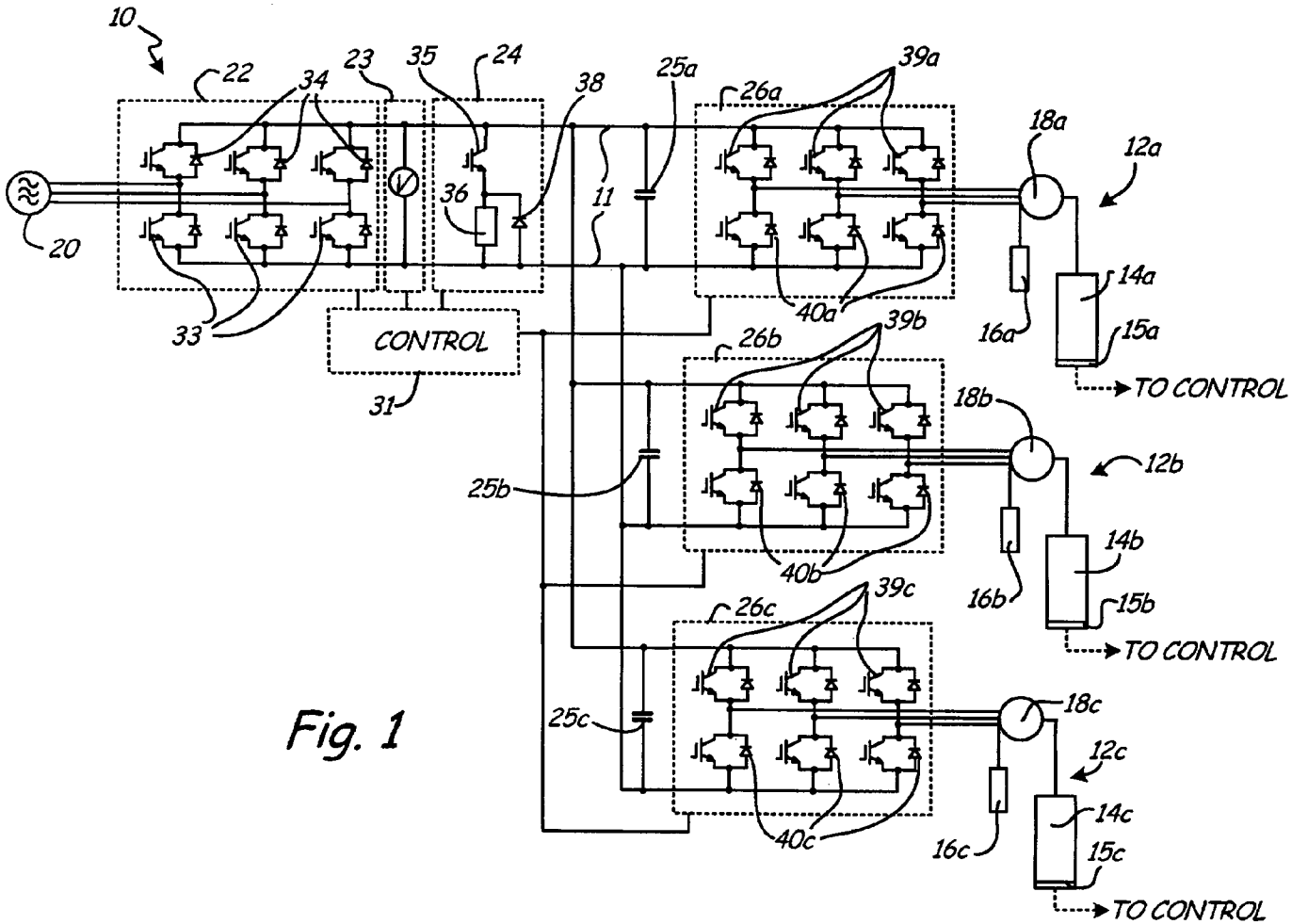
FIG. 1 is a schematic view of a power system including a common power bus for driving a plurality of elevators in a group elevator system according to an embodiment of the present invention.

FIG. 1 is a schematic view of power system 10 including a common DC bus 11 connected to a plurality of elevators 12*a*, 12*b*, and 12*c* in a group elevator system according to an embodiment of the present invention. Elevator 12*a* includes elevator cab 14*a*, cab weight sensor 15*a*, counterweight 16*a*, and hoist motor 18*a*. Elevators 12*b* and 12*c* include similar components that are labeled with like reference numerals. While three elevators 12*a*-12*c* are shown in FIG. 1, it will be appreciated that power system 10 of present invention may be adapted for use in elevator systems including any number of elevators.

Power system 10 includes three-phase AC power supply 20, power converter 22, voltage sensor 23, dynamic brake 24, smoothing capacitors 25*a*, 25*b*, and 25*c*, power inverters 26*a*, 26*b*, and 26*c*, and controller 31. Power converter 22 and power inverters 26*a*-26*c* are connected by common DC bus 11. Dynamic brake 24 is connected across common DC bus 11, and smoothing capacitors 25*a*-25*c* are connected in parallel across the inputs to power inverters 26*a*-26*c*, respectively. Controller 31 is connected to cab weight sensors 15*a*-15*c*, power converter 22, voltage sensor 23, dynamic brake 24, and power inverters 26*a*-26*c*.

Three-phase AC power supply 20, which may be a commercial power source, provides electrical power to power converter 22. Power converter 22 is a three-phase power inverter that is operable to convert three-phase AC power from power supply 20 to DC power. In one embodiment, power converter 22 comprises a plurality of power transistor circuits including parallel-connected transistors 33 and diodes 34. Each transistor 33 may be, for example, an insulated gate bipolar transistor (IGBT). The controlled electrode (i.e., gate or base) of each transistor 33 is connected to controller 31. Controller 31 thus controls the power transistor circuits to rectify the three-phase AC power from power supply 20 to DC output power. The DC output power is provided by power converter 22 on common DC bus 11. It should be noted that while power supply 20 is shown as a three-phase AC power supply, power system 10 may be adapted to receive power from any type of power source, including a single phase AC power source and a DC power source.

The power transistor circuits of power converter 22 also allow power on common DC bus 11 to be inverted and provided to power supply 20. In one embodiment, controller 31 employs pulse width modulation (PWM) to produce gating pulses so as to periodically switch the transistors 33 of power converter 22 to provide a three-phase AC power signal to power supply 20. This regenerative configuration reduces the demand on power supply 20. In another embodiment, power converter 22 comprises a three-phase diode bridge rectifier.

Dynamic brake 24 is connected across common DC bus 11 and includes brake transistor 35, brake resistor 36, and brake diode 38. Brake resistor 36 and brake diode 38 are connected in parallel, which are in turn are connected in series with brake transistor 35. In one embodiment, brake transistor 35 is an IGBT. The controlled electrode (i.e., gate or base) of brake transistor 35 is connected to controller 31. Dynamic brake 24 is provided across common DC bus 11 to dissipate excess energy on common DC bus 11. Controller 31 monitors the voltage across common DC bus 11 (for example, via voltage sensor 23 or with an overvoltage detection circuit) to assure that the voltage across common DC bus 11 does not exceed a threshold voltage level. This threshold voltage level, which may be programmed into controller 31, is set to prevent overloading of the components of power system 10. If the voltage across common DC bus 11 reaches the threshold voltage level, controller 31 activates brake transistor 35. This causes the excess energy on common DC bus 11 to be dissipated as heat across brake resistor 36.

Power inverters 26*a*-26*c* are three-phase power inverters that are operable to invert DC power from common DC bus 11 to three-phase AC power. Power inverter 26*a* comprises a plurality of power transistor circuits including parallel-connected transistors 39*a* and diodes 40*a*, and power inverters 26*b* and 26*c* include similar components that are labeled with like reference numerals. Each transistor 39*a*-39*c* may be, for example, an insulated gate bipolar transistor (IGBT). In one embodiment, the controlled electrode (i.e., gate or base) of each transistor 39*a*-39*c* is controlled by controller 31 to invert the DC power on common DC bus 11 to three-phase AC output power. The three-phase AC power at the outputs of power inverters 26*a*-26*c* is provided to hoist motors 18*a*-18*c*, respectively. In one embodiment, controller 31 employs PWM to produce gating pulses to periodically switch transistors 39*a*-39*c* of inverters 26*a*-26*c*, respectively, to provide a three-phase AC power signal to hoist motors 18*a*-18*c*, respectively. Controller 31 may vary the speed and direction of movement of elevators 12*a*-12*c* by adjusting the frequency and magnitude of the gating pulses to respective transistors 39*a*-39*c*.

In addition, the power transistor circuits of power inverters 26*a*-26*c* are operable to rectify power that is generated when elevators 12*a*-12*c*, respectively, drive respective hoist motors 18*a*-18*c*. For example, if hoist motor 18*a* is generating power, controller 31 deactivates transistors 39*a* in power inverter 26*a* to allow the generated power to be rectified by diodes 40*a* and provided to common DC bus 11. Smoothing capacitors 25*a*, 25*b*, and 25*c* smooth the rectified power provided by power inverters 26*a*-26*c* on common DC bus 11.

Hoist motors 18*a*-18*c* control the speed and direction of movement between respective elevator cabs 14*a*-14*c* and counterweights 16*a*-16*c*. The power required to drive each hoist motor 18*a*-18*c* varies with the acceleration and direction of elevators 12*a*-12*c*, respectively, as well as the load in elevators 12*a*-12*c*, respectively. For example, if elevator 12*a* is being accelerated, run up with a load greater than the weight of counterweight 16*a* (i.e., heavy load), or run down with a load less than the weight of counterweight 16*a* (i.e., light load), a maximal amount of power is required to drive hoist motor 18*a* (i.e., highly positive power demand). If elevator 12*a* is leveling or running at a fixed speed with a balanced load, it may be using a lesser amount of power (i.e., positive power demand). If elevator 12*a* is being decelerated, running down with a heavy load, or running up with a light load, elevator 12*a* drives hoist motor 18*a* (i.e., negative power demand). In this case, hoist motor 18*a* generates three-phase AC power that is converted to DC power by power inverter 26*a* under the control of controller 31. The converted DC power is accumulated on common DC bus 11.

In accordance with the present invention, controller 31 monitors the energy on common DC bus 11 via voltage sensor 23 and coordinates operation of elevators 12*a*-12*c* to maximize efficient use of power on common DC bus 11. In particular, controller 31 staggers startup and acceleration of elevators 12*a*-12*c* to avoid overlap of the current transients that occur when hoist motors 18*a*-18*c* are started or stopped. This avoids the possibility of overloading power supply 20 by preventing simultaneous starting of all elevators 12*a*-12*c*. Also, controller 31 coordinates operation of power inverters 26*a*-26*c* to shift power between hoist motors 18*a*-18*c* connected to common DC bus 11. In particular, controller 31 may control operation of power inverters 26*a*-26*c* to provide power generated by negative power demand hoist motors to positive power demand hoist motors. This is especially important during peak power requirements of a hoist motor having positive power demand, such as upon startup of the hoist motor.

FIG. 1 also shows cab weight sensors 15*a*-15*c* connected to controller 31. Cab weight sensors 15*a*-15*c* are operable to sense the weight of the load in its associated elevator cab, and may be connected to controller 31 by a conductive wire or via a wireless connection. In one embodiment, cab weight sensors 15*a*-15*c* are positioned on the bottom of elevator cabs 14*a*-14*c*, respectively, between the cab and the frame of the elevator cab to sense the load via the cab floor. In another embodiment, cab weight sensors 15*a*-15*c* are hitch sensors used in conjunction with hitch systems associated with hoist motors 18*a*-18*c*, respectively, that are operable to sense the load on the ropes connected to respective elevator cabs 14*a*-14*c*. Multiple load sensors may also be used simultaneously in connection with elevator cabs 14*a*-14*c* to provide more accurate sensing of the load in the cabs.

The information provided by cab weight sensors 15*a*-15*c* may be used by controller 31 to more efficiently control operation of power system 10. For example, prior to operation the loads sensed by cab weight sensors 15*a*-15*c* may be used by controller 31 to establish whether hoist motors 18*a*-18*c*, respectively, either will require energy to deliver the load in elevator cabs 14*a*-14*c*, respectively, or will regenerate energy while delivering the load. That is, controller 31 can process data from cab weight sensors 15*a*-15*c* and, prior to dispatching of elevators 12*a*-12*c*, the expected power requirements of each elevator 12*a*-12*c* may be determined based on the measured load in each elevator and data stored in controller 31 relating to the weights of elevator cabs 14*a*-14*c* and counterweights 16*a*-16*c*. Controller 31 may also determine whether hoist motors 18*a*-18*c* have positive or negative power demand based on, for example, current feedback from a current sensor connected to each hoist motor or torque feedback from a torque sensor connected to each hoist motor. Thus, if hoist motor 18*a* has negative power demand and hoist motor 18*b* has positive power demand, for example, controller 31 disables transistors 39*a* and operates transistors 39*b* to allow the power generated by hoist motor 18*a* to be drawn from common DC bus 11 by hoist motor 18*b*. Controller 31 may use this information to schedule operation to minimize peak current draw and overall energy consumption from power supply 20.

By connecting hoist motors 18*a*-18*c* through power inverters 26*a*-26*c*, respectively, to common DC bus 11, several advantages are realized by power system 10 that allows for reduced draw from power supply 20. For example, power generated by hoist motors 18*a*-18*c* during periods of negative power demand may be accessed on common DC bus 11 by any of the other hoist motors. This avoids the power loss that occurs in conventional systems in which power on the DC bus must be converted to AC through a dedicated power inverter. Also, only one power converter 22 is needed for power system 10, which may be sized to provide peak power during periods of highly positive power demand, such as upon the startup of multiple elevators 12*a*-12*c*. In addition, the demand on power supply 20 is reduced due to the availability of regenerated power from hoist motors 18*a*-18*c* on common DC bus 11.

Furthermore, in the event of a power failure or a malfunction in power supply 20, energy available on common DC bus 11 may be used to power hoist motors 18*a*-18*c* for limited emergency and rescue operation of elevators 12*a*-12*c*.

Controller 31 uses the information from cab weight sensors 15*a*-15*c* to further control distribution of power to and from common DC bus 11. In particular, because controller 31 can establish the relative power demands of each elevator 12*a*-12*c* prior to dispatching, controller 31 may schedule operation of elevators 12*a*-12*c* to most efficiently use the power provided to common DC bus 11 by power supply 20 and generating hoist motors. For example, when power supply 20 is operating normally, controller 31 may schedule dispatching of elevators 12*a*-12*c* to optimize dispatching efficiency. On the other hand, during a partial or complete power failure, controller 31 may favor managing motion of elevator cabs 14*a*-14*c* over efficient dispatching of elevator cabs 14*a*-14*c* to minimize net power drawn from common DC bus 11 and power supply 20. Controller 31 may also schedule operation of elevators 12*a*-12*c* to avoid overloading common DC bus 11 or power supply 20 during transient heavy load conditions. Furthermore, controller 31 may maintain a record of the power demands by hoist motors 18*a*-18*c* to anticipate future power demands based on the expected load in elevator cabs 14*a*-14*c*.

In the event of a total power failure, a partial power failure (i.e., a brown-out condition), or a malfunction in power supply 20, controller 31 may communicate with cab weight sensors 15*a*-15*c* to most efficiently use the power available on common DC bus 11 for limited emergency and rescue operation of elevators 12*a*-12*c*. For example, controller 31 may sense the load in elevators 12*a*-12*c* and schedule operation of hoist motors 18*a*-18*c*, respectively, to minimize drain on the accumulated power. Thus, controller 31 causes elevator cabs 14*a*-14*c* having light or no load to rise to the top of the building or to the most highly populated floor in the building. This causes hoist motors 18*a*-18*c* to generate power because the counterweights weigh more than an empty or lightly loaded elevator cab. As elevator cabs 14*a*-14*c* start downward, passengers are picked up to increase the load in each cab. Once the load in the elevator cab exceeds the weight of the counterweight, the hoist motor begins to generate power. Thus, controller 31 maximizes the power generated by hoist motors 18*a*-18*c* and minimizes the power drawn from common DC bus 11.

Controller 31 is further operable to direct passengers to increase loads in elevators to provide negative power demand by hoist motors 18*a*-18*c* and to limit loads in positive power demand conditions by directing passengers to board another of elevators 12*a*-12*c* or wait for an elevator to return with less load. Controller 31 may relay elevator boarding instructions to passengers via a display system or an audio system incorporated with the elevator hall call buttons or destination entry system located outside elevators 12*a*-12*c*. These components may also be powered by common DC bus 11. Thus, to the extent possible, controller 31 balances positive and negative power demand to minimize the rate of power draw from common DC bus 11. In this way, power system 10 allows elevators 12*a*-12*c* to make more trips in the event of a total or partial power failure.

In the event of a failure of any component of elevators 12*a*-12*c*, the hoist motor of the failed elevator is disconnected from common DC bus 11 to prevent the disabled elevator from drawing power from common DC bus 11. In one embodiment, controller 31 disconnects the hoist motor of the failed elevator from common DC bus 11 via a logic controlled device. Alternatively, electrical components such as fusible links, relays, and circuit breakers may be incorporated between each hoist motor 18*a*-18*c* and common DC bus 11 to disconnect an elevator from common DC bus 11 upon failure.

Figure 2:
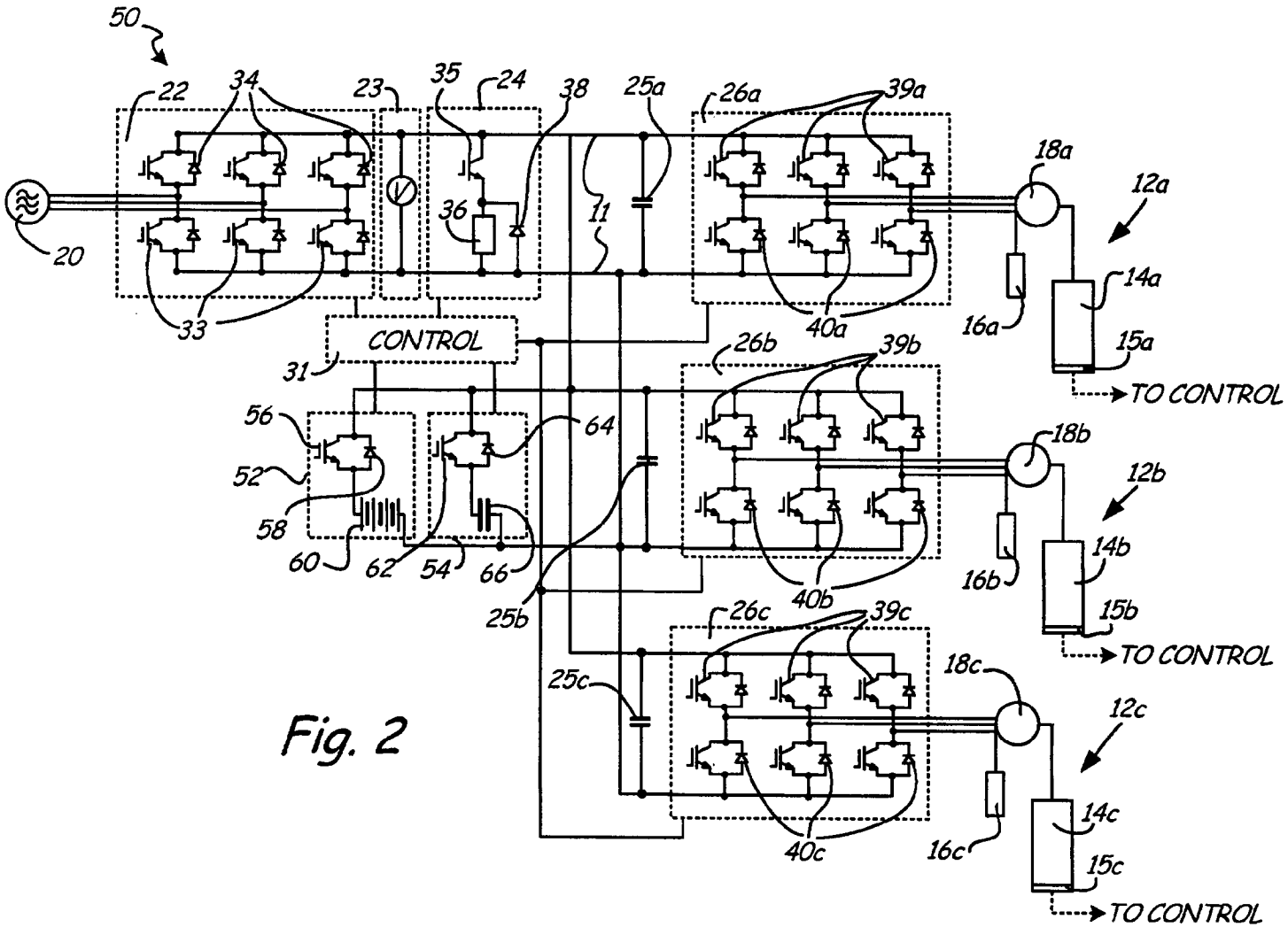
FIG. 2 is a schematic view of a power system including a common power bus and energy storage connected to the common power bus for driving a plurality of elevators in a group elevator system according to another embodiment of the present invention.

To further increase the efficient use of power on common DC bus 11, energy storage devices may be incorporated into system 10 to store excess energy provided on common DC bus 11. FIG. 2 is a schematic view of power system 50 including battery storage module 52 and capacitive storage module 54 connected across common DC bus 11. Battery storage module 52 includes a power transistor circuit including transistor 56 connected in parallel with diode 58. The power transistor circuit in battery storage module 52 is connected series with battery 60. Similarly, capacitive storage module 54 includes a power transistor circuit including transistor 62 connected in parallel with diode 64. The power transistor circuit in capacitive storage module 54 is connected in series with supercapacitor 66.

Battery storage module 52 and capacitive storage module 54 store excess power output from power converter 22 and from power inverters 26*a*-26*c* during periods of negative power demand by hoist motors 18*a*-18*c*. The energy stored in battery storage module 52 and capacitive storage module 54 may be used to power hoist motors 18*a*-18*c* during periods of positive power demand. Capacitive storage module 54 is connected in parallel with battery storage module 52 to provide a current boost during periods of peak power demand by hoist motors 18*a*-18*c* (e.g., when an elevator starts up). This reduces the overall demand from power supply 20. The controlled electrodes (i.e., gates or bases) of transistor 56 in battery storage module 52 and transistor 62 in capacitive storage module 54 are connected to controller 31. This allows controller 31 to manage the power stored in battery storage module 52 and capacitive storage module 54 to assure that power demands are satisfied efficiently. More specifically, during periods of positive power demand, controller 31 disables transistor 56 and/or transistor 62 to allow power stored in battery 60 and supercapacitor 66, respectively, to be available on common DC bus 11 through diodes 58 and 64, respectively. During periods of negative power demand, controller 31 enables transistor 56 and transistor 62 to allow excess power on common DC bus 11 to be stored in battery 60 and supercapacitor 66, respectively.

During a power failure, controller 31 communicates with cab weight sensors 15*a*-15*c* to most efficiently use the power available in battery storage module 52 and capacitive storage module 54 for limited emergency and rescue operation of elevators 12*a*-12*c*. For example, controller 31 may sense the load in elevators 12*a*-12*c* and schedule operation of hoist motors 18*a*-18*c*, respectively, to minimize drain on the energy stored in battery storage module 52 and capacitive storage module 54. In addition, during a brown-out condition (i.e., low voltage at power supply 20), controller 31 controls dispatching of elevators 12*a*-12*c* to allow recharging of battery storage module 52 and capacitive storage module 54 by trickle charging from power supply 20 between runs. This allows power system 10 to continue operation of elevators 12*a*-12*c* despite the poor power availability from power supply 20.

When the power provided to common DC bus 11 by power supply 20 and hoist motors 18*a*-18*c* during negative power demand exceeds the storage capacity of battery storage module 52 and capacitive storage module 54, the voltage across common DC bus 11 begins to increase. Controller 31 monitors the voltage across common DC bus 11 (for example, with a voltage sensor or an overvoltage detection circuit) to assure that the power provided to power inverters 26*a*-26*c* during positive power demand conditions does not exceed the power rating of the power inverters. This threshold voltage level may be programmed into controller 31. If the voltage across common DC bus 11 reaches the threshold voltage level, controller 31 activates brake transistor 35. This causes the excess energy on common DC bus 11 to be dissipated as heat across brake resistor 36.

By incorporating battery storage module 52 and capacitive storage module 54 into power system 50, several advantages are realized. For example, storing the excess energy generated during periods of negative power demand on hoist motors 18*a*-18*c* avoids the loss of energy associated with converting the power on common DC bus 11 to three-phase AC power through power converter 22. Also, the demand on power supply 20 is reduced by the storage capabilities of battery storage module 52 and capacitive storage module 54. In addition, in the event of a power failure or a malfunction in power supply 20, energy stored in battery storage module 52 and capacitive storage module 54 may be used to power hoist motors 18*a*-18*c* for limited emergency and rescue operation of elevators 12*a*-12*c*. Furthermore, other building systems may be connected to common DC bus 11 to share the energy stored in battery storage module 52 and capacitive storage module 54. Other systems that may be connected to common DC bus 11 include building emergency lighting systems, communication systems, security systems, escalator systems, and heating, ventilation, and air conditioning (HVAC) systems.

In summary, the present invention is a power system for operating a plurality of hoist motors, each of which controls movement of one of a plurality of elevators. The power system includes a power bus and a converter connected across the power bus for converting alternating current (AC) power from an AC power source to direct current (DC) power and delivering the DC power to the power bus. The power system also includes a plurality of inverters connected across the power bus. Each inverter is connected to a hoist motor and operable to drive the hoist motor when the hoist motor is motoring by converting the DC power from the power bus into AC power. Each inverter is further operable to convert AC power produced by the hoist motor when the motor is generating DC power and to deliver the DC power to the power bus. A controller manages power accumulated on the power bus by controlling operation of the converter and the inverters to drive a motoring hoist motor with power delivered to the power bus by the converter and generating hoist motors. By controlling operation of the elevator based on the power demands, power produced by the power supply and by the hoist motor during regeneration is efficiently used. This reduces the power demands of the overall power system, thereby allowing for a reduction in the size of the power supply.

Although the present invention has been described with reference to examples and preferred embodiments, workers skilled in the art will recognize that changes may be made in form and detail without departing from the spirit and scope of the invention. For example, controller 31 may be connected to other existing or added sensors in the elevator system to further enhance active power management in the elevator system. Other such sensors include torque sensors in the hoist motors and voltage or current sensors connected to the power supply.

The invention claimed is:

1. A power system for operating a plurality of hoist motors, each hoist motor for controlling movement of one of a plurality of elevators, the power system comprising:

a power bus;

a converter connected across the power bus for converting alternating current (AC) power from an AC power source to direct current (DC) power and delivering the DC power to the power bus;

a plurality of inverters connected across the power bus, each inverter connected to a hoist motor and operable to drive the hoist motor when the hoist motor is motoring by converting the DC power from the power bus into AC power, each inverter further operable to convert AC power produced by the hoist motor when the motor is generating to DC power and to deliver the DC power to the power bus; and a controller for managing power on the power bus by controlling operation of the converter and the inverters to drive a motoring hoist motor with power provided to the power bus by the converter and generating hoist motors, wherein the controller staggers dispatching of the plurality of elevators to prevent overlapping current transients in the hoist motors which occur upon starting and accelerating an elevator.

2. The power system of claim 1, and further comprising:

a sensor associated with each elevator which is operable to sense an operating parameter related to the elevator and provide a signal to the controller related to the operating parameter.

3. The power system of claim 2, wherein the controller further manages power on the power bus based on the sensed operating parameter.

4. The power system of claim 2, wherein the sensor comprises an elevator weight sensor and the operating parameter is elevator load weight.

5. The power system of claim 4, wherein the controller determines whether each hoist motor is motoring or generating based on the elevator load weight and controls operation of the inverters based on the elevator load weight.

6. The power system of claim 1, and further comprising:

a power storage device attached to the power bus to store power delivered to the power bus by the converter and generating hoist motors and to supply stored power to motoring hoist motors.

7. The power system of claim 6, wherein the power storage device is connected to the controller and the controller manages power exchanged between the power bus and the power storage device based on power demands of the hoist motors.

8. The power system of claim 6, wherein during partial failure of the AC power supply the controller controls dispatching of the elevators to allow recharging of the power storage device by trickle charging from the AC power supply between dispatches.

9. The power system of claim 1, and further comprising:

a dynamic brake connected across the power bus to dissipate power on the power bus when the voltage across the power bus reaches a threshold level.

10. A power system for operating a plurality of hoist motors, each hoist motor for controlling movement of one of a plurality of elevators, the power system comprising:

a direct current (DC) power bus;

a power source connected to the DC power bus;

a plurality of inverters, each inverter connected between the DC power bus and one of the plurality of hoist motors; and a controller for operating each inverter to deliver electrical energy from the DC power bus to a hoist motor when the hoist motor is operating as a motor and to deliver regenerated electrical energy from the hoist motor to the DC power bus when the hoist motor is operating as a generator, wherein the controller staggers dispatching of the plurality of elevators to prevent overlapping current transients in the hoist motors which occur upon starting and accelerating an elevator.

11. The power system of claim 10, and further comprising:

a sensor associated with each elevator which is operable to sense an operating parameter related to the elevator and provide a signal to the controller related to the operating parameter.

12. The power system of claim 10, wherein the sensor comprises an elevator weight sensor and the operating parameter is elevator load weight.

13. The power system of claim 12, wherein the controller determines whether each hoist motor is motoring or generating based on the elevator load weight and controls dispatching of the elevators based on the elevator load weight.

14. The power system of claim 10, and further comprising:

a power storage device attached to the power bus to store power delivered to the power bus by the converter and generating hoist motors and to supply stored power to motoring hoist motors.

15. The power system of claim 14, wherein the power storage device is connected to the controller and the controller manages power exchanged between the power bus and the power storage device based on power demands of the hoist motors.

16. A method for operating a plurality of hoist motors connected to a common power bus, each hoist motor for controlling movement of one of a plurality of elevators, the method comprising:

delivering electrical energy generated by a generating hoist motor to the common power bus;

delivering electrical energy from the common power bus to a motoring hoist motor; and staggering dispatching of the elevators to prevent overlapping current transients in the hoist motors which occur upon starting and accelerating an elevator.

17. The method of claim 16 and further comprising:

sensing a load weight of each elevator;

determining whether an elevator is motoring or generating as a function of the load weight.

18. The method of claim 16, and further comprising:

storing power delivered to the common power bus by generating hoist motors.

* * * * *